US009449550B2

(12) United States Patent
Lee et al.

(10) Patent No.: US 9,449,550 B2
(45) Date of Patent: Sep. 20, 2016

(54) ORGANIC LIGHT EMITTING DIODE DISPLAY DEVICE

(75) Inventors: Jae-Yong Lee, Suwon-si (KR); Yang-Wan Kim, Suwon-si (KR)

(73) Assignee: Samsung Display Co., Ltd., Yongi-si (KR)

( * ) Notice: Subject to any disclaimer, the term of this patent is extended or adjusted under 35 U.S.C. 154(b) by 1153 days.

(21) Appl. No.: 12/122,130

(22) Filed: May 16, 2008

(65) Prior Publication Data

US 2008/0316150 A1 Dec. 25, 2008

(30) Foreign Application Priority Data

Jun. 21, 2007 (KR) ..... 10-2007-0061257

(51) Int. Cl.
*G09G 3/3208* (2016.01)
*G09G 3/32* (2016.01)

(52) U.S. Cl.
CPC ..... *G09G 3/3233* (2013.01); *G09G 3/3291* (2013.01); *G09G 2300/0465* (2013.01); *G09G 2300/0819* (2013.01); *G09G 2300/0852* (2013.01); *G09G 2300/0861* (2013.01); *G09G 2310/0297* (2013.01); *G09G 2320/0233* (2013.01); *G09G 2330/021* (2013.01)

(58) Field of Classification Search
CPC ..... G09G 5/00; G09G 3/00
USPC ..... 345/55, 76, 55.76
See application file for complete search history.

(56) References Cited

U.S. PATENT DOCUMENTS 6,521,913 B1 2/2003 Murade
2004/0095298 A1* 5/2004 Miyazawa ..... G09G 3/3233 345/76
2005/0083270 A1* 4/2005 Miyazawa ..... 345/76
2006/0043527 A1 3/2006 Kwak
2006/0066532 A1* 3/2006 Jeong ..... 345/76
2006/0071883 A1* 4/2006 Oh ..... G09G 3/3233 345/76
2006/0118788 A1 6/2006 Park
2006/0132399 A1 6/2006 Miyazawa (Continued)

FOREIGN PATENT DOCUMENTS

EP 1 416 466 10/2003
EP 1 416 466 A2 5/2004
EP 1 947 633 7/2008

(Continued)

OTHER PUBLICATIONS

European Search Report issued in European Patent Application No. 08252154.3 on Oct. 27, 2008.

(Continued)

*Primary Examiner* — Nicholas Lee
*Assistant Examiner* — Duane N Taylor, Jr.
(74) *Attorney, Agent, or Firm* — Lewis Roca Rothgerber Christie LLP

(57) ABSTRACT

An organic light emitting diode (OLED) display device minimizes a threshold voltage variation of a drive transistor in a pixel circuit, increases an aperture ratio, and minimizes power consumption by applying a same range of data voltages to respective pixels. The OLED display device includes a first capacitor electrically connected between a first node and a power supply line; and a second capacitor electrically connected between the first node and a second node, wherein capacitances of the first and second capacitors are different from each other and adjustable.

20 Claims, 4 Drawing Sheets

(56) References Cited

U.S. PATENT DOCUMENTS

| | | | | |
|---|---|---|---|---|
| 2006/0221662 | A1* | 10/2006 | Park | G09G 3/3233 365/145 |
| 2006/0267885 | A1* | 11/2006 | Kwak et al. | 345/76 |

FOREIGN PATENT DOCUMENTS

| | | |
|---|---|---|
| JP | 07-111341 | 4/1995 |
| JP | 2002-149112 | 5/2002 |
| JP | 2003-016755 | 1/2003 |
| JP | 2003-167533 | 6/2003 |
| JP | 2003-195838 | 7/2003 |
| JP | 2004-145281 | 5/2004 |
| JP | 2005-099715 | 4/2005 |
| JP | 2005-352398 | 12/2005 |
| JP | 2008-176272 | 7/2008 |
| JP | 4989415 | 8/2012 |
| KR | 2004-21845 | 3/2004 |
| KR | 2005-14849 | 2/2005 |
| KR | 2005-104605 | 11/2005 |
| KR | 2005-104610 | 11/2005 |
| KR | 2006-12931 | 2/2006 |
| KR | 2006-19022 | 3/2006 |
| KR | 10-570763 | 4/2006 |
| KR | 2006-50204 | 5/2006 |
| KR | 2006-63254 | 6/2006 |
| KR | 10-0599727 | 7/2006 |
| KR | 10-599791 | 7/2006 |
| KR | 1020060119294 | * 10/2006 |
| KR | 2007-12979 | 1/2007 |
| KR | 2007-64438 | 6/2007 |
| KR | 2008-48831 | 6/2008 |
| WO | WO 2006/054189 | 5/2006 |

OTHER PUBLICATIONS

Matsueda, Y. et al.; "AMOLED with Integrated 6-Bit Gamma Compensated Digital Data Driver", SID 04 Digest, pp. 1116-1119.
U.S. Appl. No. 12/013,698, filed Jan. 14, 2008, Jae-Yong Lee et al., Samsung Mobile Display Co., Ltd.
Korean Publication No. 2005-104611, dated Nov. 3, 2005. (Abstract in English).
Korean Publication No. 2005-110940, dated Nov. 24, 2005. (Abstract in English).
Notice of Allowability issued in Korean Patent Application No. 2007-61256 on Aug. 28, 2008.
Notice of Allowability issued in Korean Patent Application No. 2007-61257 on Nov. 20, 2008.
Office Action issued in U.S. Appl. No. 12/013,698 on Jul. 23, 2009.
Patent Abstracts of Japan for Japanese Publication 2009-003405, dated Jan. 8, 2009, corresponding to Japanese Patent 4989415.

* cited by examiner

ORGANIC LIGHT EMITTING DIODE DISPLAY DEVICE

CROSS-REFERENCE TO RELATED APPLICATION

This application claims the benefit of Korean Patent Application No. 2007-61257, filed Jun. 21, 2007, the disclosure of which is hereby incorporated herein by reference.

BACKGROUND OF THE INVENTION

1. Field of the Invention

Aspects of the present invention relate to an organic light emitting diode (OLED) display device capable of minimizing a threshold voltage variation of a driving transistor in a pixel circuit, minimizing lowering of an aperture ratio, and minimizing power consumption by applying the same range of data voltages to respective pixels.

2. Description of the Related Art

Flat panel display devices, for example, liquid crystal display devices and organic light emitting diode (OLED) display devices, are lightweight and thin and are widely used as alternatives to cathode ray tube (CRT) display devices. Among these flat panel display devices, OLED display devices, in particular, have attracted considerable attention for their advantages of excellent brightness, wide viewing angle, and extra-thinness due to a back-light being unnecessary in comparison with LCD.

OLED display devices display images by forming excitons through the recombination of electrons and holes injected into an organic thin film from a cathode and an anode. The excitons generate a specific wavelength of light as the electrons and holes recombine.

OLED display devices are classified as a passive matrix type and an active matrix type depending upon the manner in which they are driven. The active matrix type has a circuit using a thin film transistor (TFT). Although the passive matrix type is easily manufactured as its display area is simply formed by an anode and a cathode in a matrix, the use of the passive matrix type is limited to small displays due to low resolution, a high driving voltage, low life-span of materials, etc. On the other hand, the active matrix type has a TFT in every pixel of a display area to apply a uniform current to each pixel, and thus may exhibit stable brightness. Also, the active matrix type plays an important role in realization of high resolution and large displays because of its low power consumption.

The OLED display devices have a specific variation in threshold voltage of a TFT in each pixel during a fabrication process of the TFT, which results in a non-uniform brightness of the OLED display device. Thus the OLED display devices generally have a pixel circuit including a compensation circuit to compensate for the threshold voltage variation. However, the OLED display device having such a compensation circuit requires several TFTs to form the compensation circuit, thereby requiring complicated pixel circuits which decrease a light emitting area due to a reduction in aperture ratio of each pixel.

Also, to realize full-color displays, the OLED display device includes several pixels, such as red, green, and blue pixels. However, since the respective pixels have different efficiencies in their own organic light emitting diodes, data signals with different voltages have to be applied to the respective pixels in order to obtain a uniform brightness from the respective pixels, and thus data driving units that apply the data signals have to be formed in each pixel. Also, a voltage range of the data signal is also increased, and thus the data driving unit is complicated and power consumption increases.

SUMMARY OF THE INVENTION

Aspects of the present invention provide an organic light emitting diode (OLED) display device, which can minimize a threshold voltage variation of a driving transistor, minimize lowering of an aperture ratio of each pixel and apply a suitable drive current to an organic light emitting diode of each pixel even when data signals having an equal voltage are applied to the respective pixels.

According to an aspect of the present invention, an OLED display device includes: an organic light emitting diode; a scan line to apply a scan signal; a control line to apply a control signal; a data line to apply a data signal; a drive transistor electrically connected between the organic light emitting diode and a second node to apply a drive current to the organic light emitting diode according to a voltage of a first node; a first switching transistor electrically connected between the data line and the first node, and the first switching transistor being turned on/off according to the scan signal from the scan line; a second switching transistor electrically connected between the second node and a power supply line, and the second switching transistor being turned on/off according to the control signal from the control line; a first capacitor electrically connected between the first node and the power supply line; and a second capacitor electrically connected between the first node and the second node, wherein capacitances of the first and second capacitors are different from each other.

According to another aspect of the present invention, an organic light emitting diode (OLED) display device comprising pixels including red, green and blue sub-pixels, and several signal lines electrically connected with the several pixels to apply a scan signal, a data signal, and a control signal, each of the red, green, and blue sub-pixels comprising: an organic light emitting diode; a drive transistor electrically connected between the organic light emitting diode and a second node to apply a drive current to the organic light emitting diode according to the voltage of a first node; a first switching transistor electrically connected between the data line and the first node, and the first switching transistor being turned on/off in response to the scan signal from a scan line of the several signal lines; a second switching transistor electrically connected between the second node and a power supply line, and the second switching transistor being turned on/off in response to the control signal from a control line of the several signal lines; a first capacitor electrically connected between the first node and the power supply line; and a second capacitor electrically connected between the first node and the second node, wherein the red, green, and blue sub-pixels are different in capacitance ratios of the first capacitors to the second capacitors.

According to yet another aspect of the present invention, an organic light emitting diode (OLED) display device comprising several signal lines to apply a scan signal, a data signal and a control signal, and several pixels to display different colors electrically connected with the several signal lines, each of the several pixels comprising: an organic light emitting diode; a drive transistor electrically connected between the organic light emitting diode and a second node to apply a drive current according to the voltage of a first node to the organic light emitting diode; a first switching transistor electrically connected between the data line and the first node, and the first switching transistor being turned on/off in response to the scan signal from a scan line of the several signal lines; a second switching transistor electrically connected between the second node and the power supply line, and the second switching transistor being turned on/off in response to the control signal from a control line of the several signal lines; a first capacitor electrically connected between the first node and the power supply line; and a second capacitor electrically connected between the first node and the second node, wherein ratios of the first capacitors to the second capacitors of each of the pixels displaying different colors among the several pixels are different from each other.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
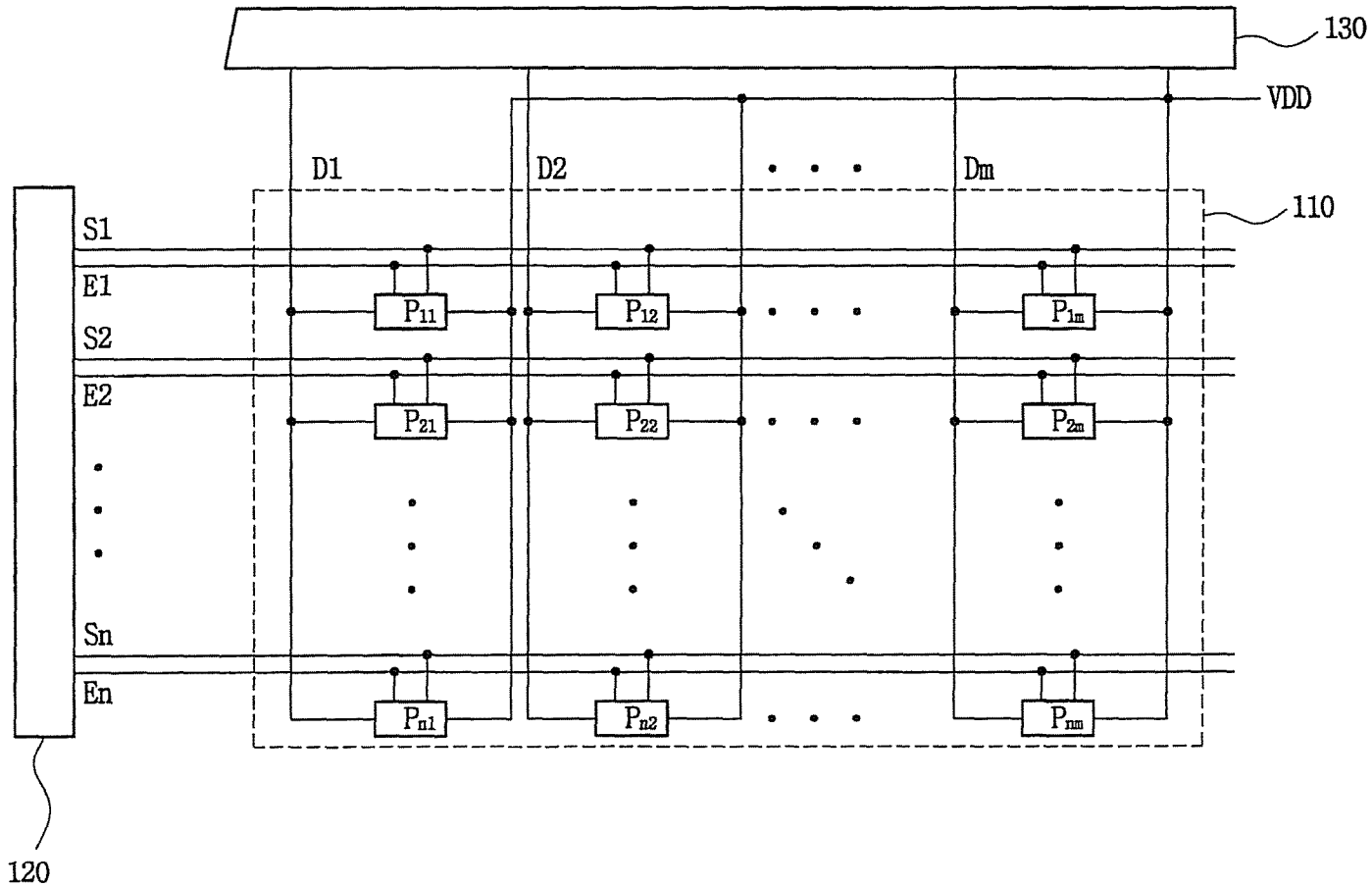
FIG. 1 is a block diagram of an organic light emitting diode (OLED) display device according to an exemplary embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures. In the drawings, length and thickness of the layers and regions may be exaggerated for clarity. Also, like numerals denote like components, and when a part is described as being "connected" with a part, the part may be "directly connected" or "electrically connected" with the part and/or a third part may be interposed therebetween.

FIG. 1 is a block diagram of an organic light emitting diode (OLED) display device according to an exemplary embodiment of the present invention. Referring to FIG. 1, the OLED display device according to this exemplary embodiment of the present invention includes a pixel unit 110 having a plurality of pixels P11~Pnm, a scan driving unit 120 electrically connected with the plurality of pixels P11~Pnm by scan lines S1~Sn to apply scan signals and control lines E1~En to apply control signals respectively to the plurality of pixels P11~Pnm, and a data driving unit 130 electrically connected with the plurality of pixels P11~Pnm by data lines D1~Dm to apply data signals to the plurality of pixels P11~Pnm. The scan driving unit 120 generates scan signals and control signals, and sequentially applies the scan and control signals through the scan lines S1~Sn and the control lines E1~En, respectively. The data driving unit 130 generates data signals, and synchronizes the data signals with the scan signals through the data lines D1~Dm to be applied to the pixel unit 110. A power voltage is applied to the pixel unit 110 from the power supply line VDD.

The pixel unit 110 includes the plurality of pixels P11~Pnm which can display a plurality of colors in order to express various gradations and emit light with specific brightness in response to the scan signals, the control signals, and the data signals.

Figure 2:
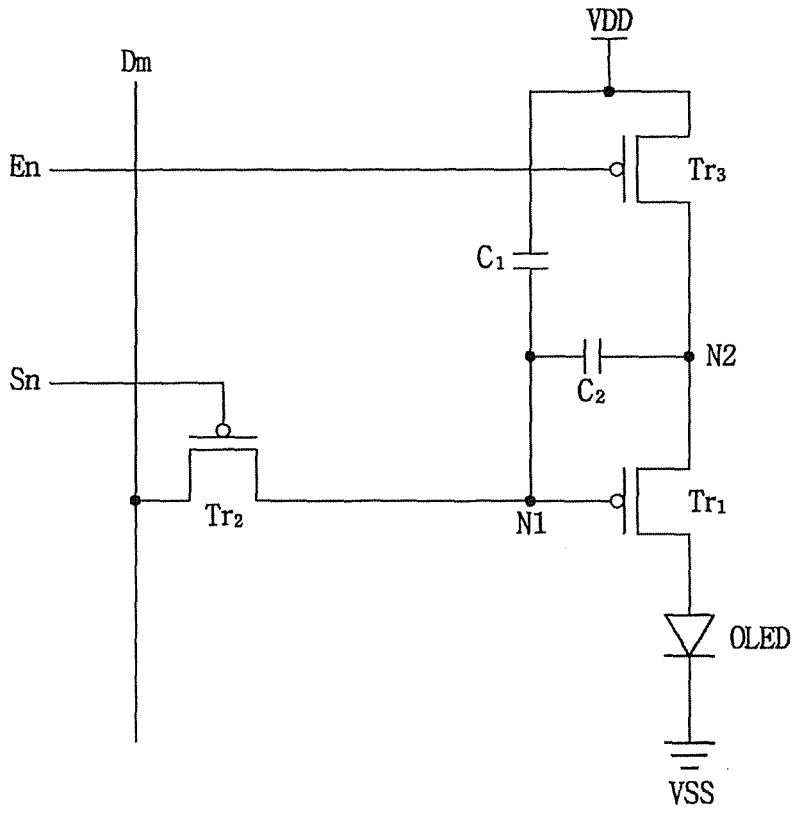
FIG. 2 is a circuit diagram of a pixel circuit of the OLED display device according to an exemplary embodiment of the present invention.

FIG. 2 is a circuit diagram of a pixel circuit of an OLED display device according to an exemplary embodiment of the present invention. Referring to FIG. 2, each pixel P11~Pnm includes an organic light emitting diode OLED, a drive transistor Tr1, a first switching transistor Tr2, a second switching transistor Tr3, a first capacitor C1 and a second capacitor C2.

The drive transistor Tr1 is electrically connected between the organic light emitting diode OLED and a second node N2, and applies a drive current to the organic light emitting diode OLED according to a voltage of a first node N1. The first switching transistor Tr2 is electrically connected between the data line Dm and the first node N1, and transmits the data signal to the first node N1 in response to or according to the scan signal applied from the scan line Sn. The second switching transistor Tr3 is electrically connected between the second node N2 and a power supply line VDD, and transmits a power voltage to the second node N2 in response to or according to the control signal applied from the control line En. The first switching transistor Tr2, the second switching transistor Tr3, and the drive transistor Tr1 may be independently NMOS or PMOS transistors. Further, the organic light emitting diode OLED is connected between the drive transistor Tr1 and a ground VSS.

The first capacitor C1 is electrically connected between the power supply line VDD and the first node N1, and stores a voltage less than or equal to a difference between the voltage of the first node N1 and the power voltage as applied from the power supply line VDD.

The second capacitor C2 is electrically connected between the first node N1 and the second node N2, and stores a voltage less than or equal to a difference between the voltage of the first node N1 and the voltage of the second node N2.

Figure 3:
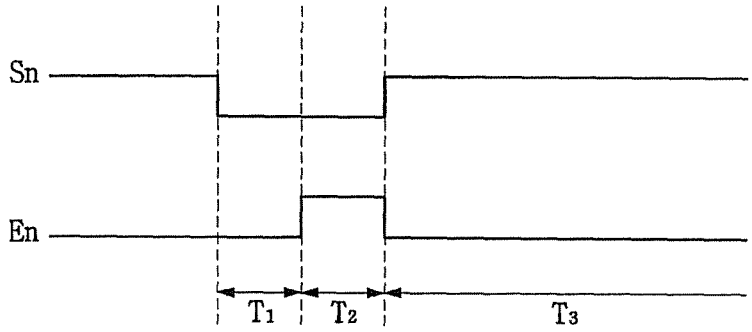
FIG. 3 is a waveform diagram illustrating the driving of a pixel circuit of the OLED display device according to an exemplary embodiment of the present invention.

FIG. 3 is a waveform diagram illustrating the driving of the pixel circuit of the OLED display device according to an embodiment of the present invention. In driving the pixel circuit of the OLED display device according to the exemplary embodiments of the present invention, with reference to FIGS. 2 and 3, a low-level scan signal and a low-level control signal are respectively applied in a first time period T1 through the scan line Sn and the control line En.

The first switching transistor Tr2 is turned-on by the low-level scan signal so that the first switching transistor Tr2 transmits a data signal applied from the data line Dm to the first node N1. Thus, the first node N1 has the same voltage as the voltage of the data signal from the data line Dm, and the first capacitor C1 electrically connected between the first node N1 and the power supply line VDD stores the voltage difference between the voltage of the data signal from the data line Dm and the power voltage from the power supply line VDD.

Also during the first time period T1, the second switching transistor Tr3 is turned-on by the low-level control signal applied thereto by the control line En, and the second switching transistor Tr3 transmits the power voltage applied from the power supply line VDD to the second node N2. Thus, the second node N2 has the same voltage as the power voltage supplied from the power supply line VDD, and the second capacitor C2 electrically connected between the second node N2 and the first node N1 stores the voltage difference between the voltage of the data signal applied from the data line Dm through the first switching transistor Tr2 and the power voltage from the power supply line VDD, which is the same as the first capacitor C1.

In the first time period T1, because the power voltage is transmitted from the power supply line VDD to the second node N2, and the data signal is transmitted to the first node N1, the drive transistor Tr1 is turned-on, and the drive transistor Tr1 applies the drive current in response to or according to the voltage of the data signal transmitted from the data line Dm to the first node N1 to the organic light emitting diode OLED. However, the first time period T1 does not affect overall brightness because the first time period T1 is shorter than the following third time period T3.

Subsequently, in a second time period T2, a low-level scan signal is applied to the scan line Sn and a high-level control signal is applied to the control line En. The first switching transistor Tr2 remains turned-on by the low-level scan signal Sn as shown in the first time period T1, and thus the first node N1 maintains the voltage of the data signal as applied from the data line Dm, and the first capacitor C1 stores the voltage difference the voltage of the data signal and the power voltage from the power supply line VDD.

The second switching transistor Tr3 is turned-off by the high-level control signal such that the power voltage is not applied from the power supply line VDD to the second node N2. The first node N1 and the second node N2 are respectively connected to a gate terminal and a source terminal of the drive transistor Tr1, and thus the second capacitor C2 stores a threshold voltage of the drive transistor Tr1, and the second node N2 maintains a voltage corresponding to the sum of the voltage of the data signal and the threshold voltage.

Accordingly, in the second time period T2, the drive transistor Tr1 is turned-on by the voltage of the data signal applied from the data line Dm to the first node N1, and applies the drive current in response to or according to the voltage of the data signal from the data line Dm transmitted to the first node N1 to the organic light emitting diode OLED as shown in the first time period T1. However, the second time period T2 does not greatly affect the overall brightness because the second time period T2 is shorter than the following third time period T3. Also, in the second time period T2, the voltage of the second node N2 stores a difference between the threshold voltage and the first node N1, so the drive transistor Tr1 does not apply a sufficient drive current to allow the organic light emitting diode OLED to exhibit sufficient brightness.

Next, in the third time period T3, a high-level scan signal is applied to the scan line Sn, and a low-level control signal is applied to the control line En. The second switching transistor Tr3 is turned-on by the low-level control signal, and thus the second node N2 has the same voltage as the power voltage as applied by the power supply line. The first switching transistor Tr2 is turned-off by the high-level scan signal from the scan line Sn, and thus the first node N1 maintains the following voltage due to a coupling effect of the first capacitor C1 and the second capacitor C2:

$$V_{N1} = V_{data} + \frac{C_2}{(C_1 + C_2)}(ELVDD - V_{data} - V_{th}),$$

wherein, $V_{N1}$ is a voltage of the first node, $C_1$ is a capacitance of the first capacitor, $C_2$ is a capacitance of the second capacitor, $V_{data}$ is a voltage of the data signal, ELVDD is a power voltage, and $V_{th}$ is a threshold voltage of the drive transistor.

In the third time period T3, the drive transistor Tr1 applies the drive current to the organic light emitting diode OLED in response to the voltage ($V_{N1}$) of the first node N1, and thus the brightness of the organic light emitting diode OLED in the third time period T3 is determined by a capacitance ratio of the first capacitor C1 and the second capacitor C2.

As a result, the OLED display device according to this exemplary embodiment of the present invention controls a capacitance ratio of the first and second capacitors C1 and C2 of each pixel P11-Pnm, and thus can apply a suitable drive current to an organic light emitting diode OLED of each pixel P11-Pnm regardless of the voltage of a data signal applied from the data line Dm to each pixel P11-Pnm.

Figure 4:
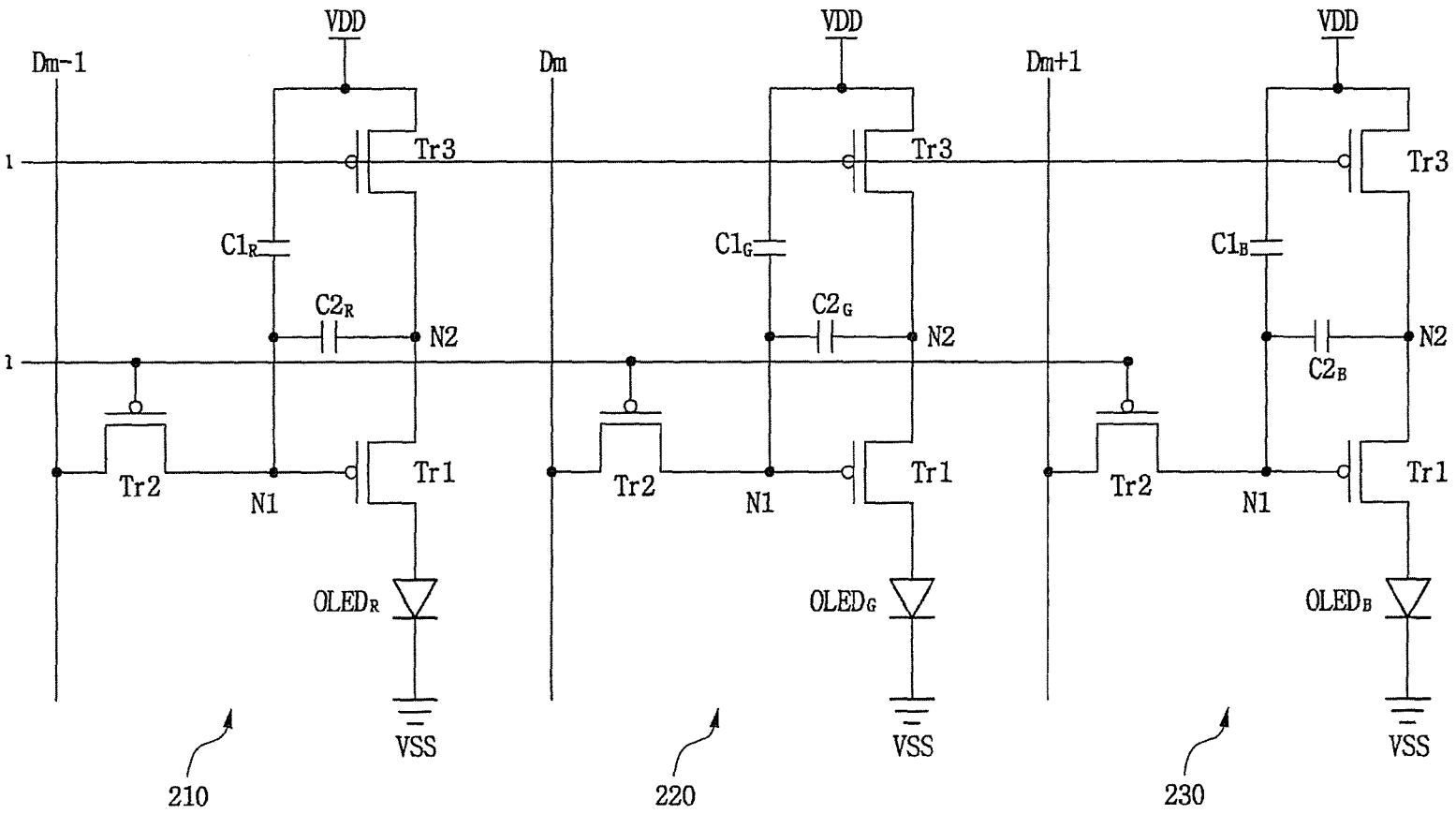
FIG. 4 is a circuit diagram of a pixel circuit of an OLED display device according to an exemplary embodiment of the present invention.

FIG. 4 is a circuit diagram of a pixel circuit of an OLED display device according to another exemplary embodiment of the present invention. Referring to FIG. 4, the pixel circuit of the OLED display device according to this exemplary embodiment of the present invention includes drive transistors Tr1; first switching transistors Tr2; second switching transistors Tr3; first capacitors $C1_R$, $C1_G$, and $C1_B$; second capacitors $C2_R$, $C2_G$, and $C2_B$; red, green, and blue pixels 210, 220, and 230 including red, green, and blue organic light emitting diodes $OLED_R$, $OLED_G$, and $OLED_B$, respectively; data lines Dm−1, Dm, Dm+1 for applying respective data signals to the red, green, and blue pixels 210, 220 and 230; a scan line Sn to apply a scan signal to the red, green, and blue pixels 210, 220, and 230; and a control line En to apply a control signal to the red, green, and blue pixels 210, 220, and 230. The red, green, and blue pixels 210, 220, and 230 are different from one another in capacitance ratios of the first capacitors $C1_R$, $C1_G$, and $C1_B$ to the second capacitors $C2_R$, $C2_G$, and $C2_B$.

The capacitance ratios of the first capacitors $C1_R$, $C1_G$, and $C1_B$ to the second capacitors $C2_R$, $C2_G$, and $C2_B$ are determined by the red, green, and blue organic light emitting diodes $OLED_R$, $OLED_G$, and $OLED_B$ in the respective pixels 210, 220, and 230. Specifically, the capacitance ratios of the first capacitors $C1_R$, $C1_G$, and $C1_B$ to the second capacitors $C2_R$, $C2_G$, and $C2_B$ in the respective pixels 210, 220, and 230 are inversely proportional to efficiencies of the red, green, and blue organic light emitting diodes $OLED_R$, $OLED_G$, and $OLED_B$ in the respective pixels 210, 220, and 230.

Thus, as the efficiencies of the organic light emitting diodes $OLED_R$, $OLED_G$, and $OLED_B$ are lowered, the second capacitors $C2_R$, $C2_G$, and $C2_B$ in the respective pixels 210, 220, and 230 have higher capacitances, and the first capacitors $C1_R$, $C1_G$, and $C1_B$ in the respective pixels 210, 220, and 230 have lower capacitances. Here, in order to control the capacitance ratios of the first capacitors $C1_R$, $C1_G$, and $C1_B$ to the second capacitors $C2_R$, $C2_G$, and $C2_B$ in the respective pixels 210, 220, and 230, the capacitances of one of both the first capacitors $C1_R$, $C1_G$, and $C1_B$ and the second capacitors $C2_R$, $C2_G$, and $C2_B$ may be set at a same capacitance in all pixels 210, 220, and 230 and those of the other capacitors may be controlled, or all capacitances of the first capacitors $C1_R$, $C1_G$, and $C1_B$ and the second capacitors $C2_R$, $C2_G$, and $C2_B$ may be controlled.

As a result, the OLED display device according to this exemplary embodiment of the present invention may differently control the capacitance ratios of the first capacitors $C1_R$, $C1_G$, and $C1_B$ to the second capacitors $C2_R$, $C2_G$, and $C2_B$ in the red, green, and blue pixels 210, 220, and 230 according to the efficiencies of the red, green, and blue organic light emitting diodes $OLED_R$, $OLED_G$, and $OLED_B$, respectively, thereby applying a suitable drive current to the red, green, and blue organic light emitting diodes $OLED_R$, $OLED_G$, and $OLED_B$, even when the data signals having the same voltage are applied to the red, green, and blue pixels 210, 220, and 230.

Figure 5:
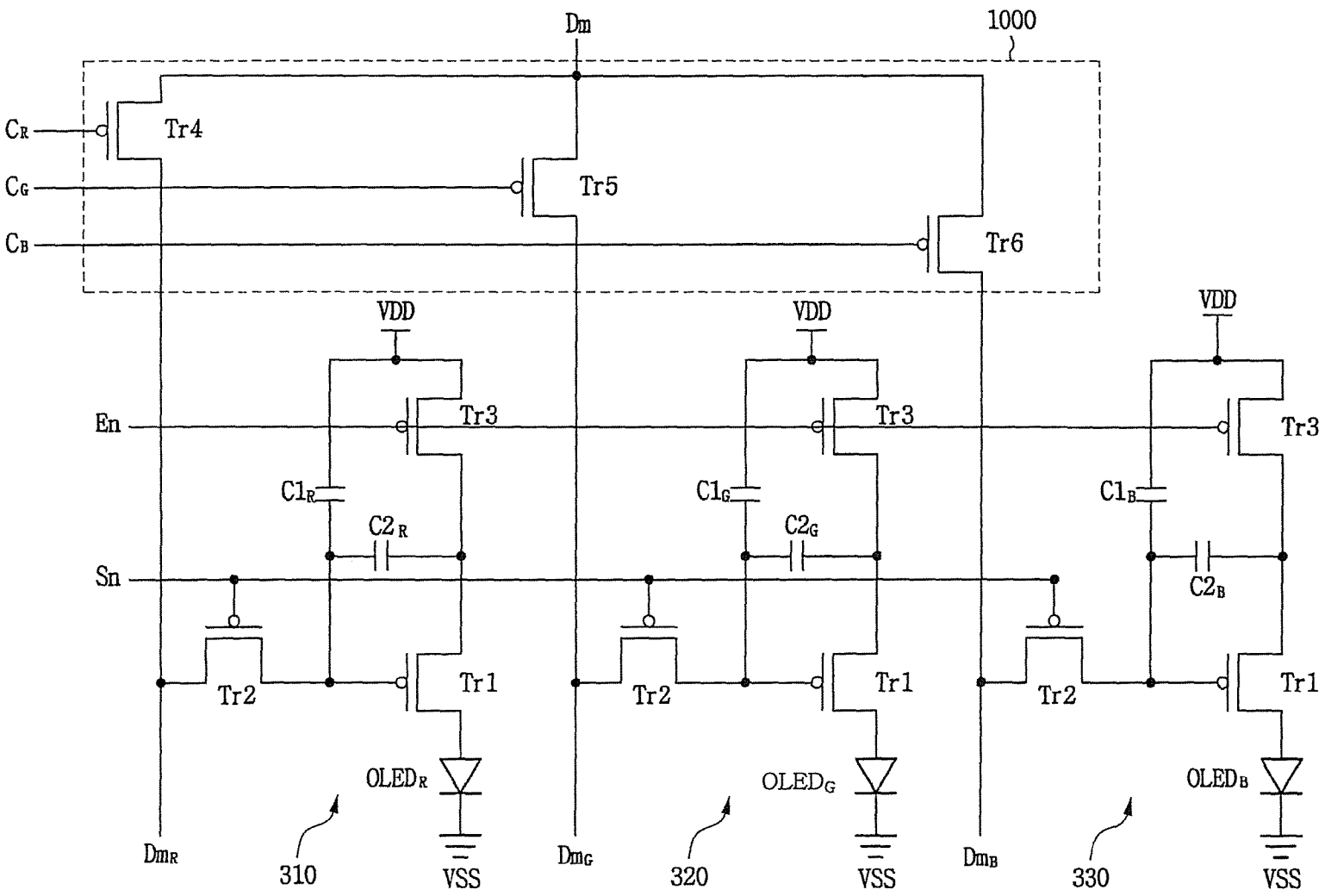
FIG. 5 is a circuit diagram of a pixel circuit of an OLED display device according to an exemplary embodiment of the present invention.

FIG. 5 is a circuit diagram of a pixel circuit of an OLED display device according to another exemplary embodiment of the present invention. Referring to FIG. 5, the pixel circuit of the OLED display device according to this exemplary embodiment includes drive transistors Tr1; first switching transistors Tr2; second switching transistors Tr3; first capacitors $C1_R$, $C1_G$, and $C1_B$; second capacitors $C2_R$, $C2_G$, and $C2_B$; red, green, and blue sub-pixels 310, 320, and 330 including red, green, and blue organic light emitting diodes $OLED_R$, $OLED_G$, and $OLED_B$, respectively; a data line Dm to apply a data signal to the sub-pixels 310, 320, and 330, a scan line Sn to apply a scan signal to the pixels 310, 320, and 330, a control line En to apply a control signal to the pixels 310, 320, and 330; and a demultiplexer 1000 electrically connected to the data line Dm to sequentially apply the data signal to the sub-pixels 310, 320, and 330. Here, the first capacitors $C1_R$, $C1_G$, and $C1_B$ and the second capacitors $C2_R$, $C2_G$, and $C2_B$ in the respective sub-pixels 310, 320, and 330 have different capacitance ratios.

The demultiplexer 1000 is electrically connected with the data line Dm, and turns on/off third, fourth, and fifth switching transistors Tr4, Tr5, and Tr6 in response to red, green, and blue data control signals $C_R$, $C_G$, and $C_B$ to thereby sequentially apply the data signal to the red, green, and blue sub-pixels 310, 320, and 330.

Accordingly, in the OLED display device according to this exemplary embodiment of the present invention, data signals having a same voltage may be sequentially applied to three sub-pixels by the demultiplexer 1000, however, the capacitance ratios of first capacitors $C1_R$, $C1_G$, and $C1_B$ to second capacitors $C2_R$, $C2_G$, and $C2_B$ may be controlled according to efficiencies of the respective organic light emitting diodes in the respective red, green, and blue sub-pixels 310, 320, and 330 to thereby apply a suitable drive current to the organic light emitting diodes $OLED_R$, $OLED_G$, and $OLED_B$ of the red, green, and blue sub-pixels 310, 320, and 330.

Consequently, the OLED display device according to this exemplary embodiment of the present invention may control the capacitance ratios of the first capacitors $C1_R$, $C1_G$, and $C1_B$ to second capacitors $C2_R$, $C2_G$, and $C2_B$ in the respective red, green, and blue sub-pixels 310, 320, and 330 according to the efficiencies of the organic light emitting diodes $OLED_R$, $OLED_G$, and $OLED_B$ of the red, green, and blue sub-pixels 310, 320, and 330, and may sequentially apply the data signal to the respective red, green, and blue sub-pixels 310, 320, and 330 by a single data line Dm through the demultiplexer 1000 to thereby reduce the number of data lines in the OLED display device and increase aperture ratios of the respective red, green, and blue pixels 310, 320, and 330.

Accordingly, an OLED display device according to aspects of the present invention may control capacitance ratios of first capacitors to second capacitors of respective pixels to apply a suitable drive current to organic light emitting diodes of the pixels even when data signals having the same voltage are applied to thereby allow for simple design of a data driving unit and to decrease power consumption of the OLED display device. Also, each pixel may include an organic light emitting diode, a first switching transistor, a second switching transistor, a drive transistor, a first capacitor, and a second capacitor to thereby minimize a threshold voltage of the drive transistor and minimize lowering of an aperture ratio of the pixels.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An organic light emitting diode (OLED) display device, comprising:

an organic light emitting diode;

a scan line to apply a scan signal;

a control line to apply a control signal;

a data line to apply a data signal;

a drive transistor comprising a source and a drain, one of which is electrically connected to the organic light emitting diode and an other of which is electrically connected to a second node to apply a drive current to the organic light emitting diode according to a voltage of a first node, the drive transistor further comprising a gate electrode electrically connected to the first node;

a first switching transistor comprising a source and a drain, one of which is electrically connected to the data line and an other of which is directly electrically connected to the gate electrode of the drive transistor at the first node, and a gate electrode electrically connected to the scan line, the first switching transistor being turned on/off according to the scan signal from the scan line;

a second switching transistor comprising a source and a drain, one of which is electrically connected to the second node and an other of which is electrically connected to a power supply line to apply at least a portion of the drive current to the organic light emitting diode via the drive transistor, and a gate electrode coupled to the control line, the second switching transistor being turned on/off according to the control signal from the control line;

a first capacitor directly electrically connected to the first node and directly electrically connected to the power supply line; and a second capacitor electrically connected between the first node and the second node, wherein capacitances of the first and second capacitors are different from each other, and wherein the second node is directly connected to a source of the drive transistor, the second capacitor, and a drain of the second switching transistor.

2. The OLED display device according to claim 1, wherein a capacitance ratio of the first capacitor to the second capacitor is inversely proportional to an efficiency of the organic light emitting diode.

3. The OLED display device according to claim 2, wherein the first capacitor has a capacitance proportional to the efficiency of the organic light emitting diode.

4. The OLED display device according to claim 2, wherein the second capacitor has a capacitance inversely proportional to the efficiency of the organic light emitting diode.

5. The OLED display device according to claim 1, wherein at least two of the first switching transistor, the second switching transistor, and the drive transistor have a same conductivity type.

6. The OLED display device according to claim 5, wherein the first switching transistor, the second switching transistor, and the drive transistor are independently NMOS or PMOS transistors.

7. An organic light emitting diode (OLED) display device, comprising:

pixels including red, green, and blue sub-pixels;

a scan line to apply a scan signal to the pixels;

a control line to apply a control signal to the pixels;

data lines to respectively apply data signals to the red, green, and blue sub-pixels; and a power supply line to provide a voltage to the pixels, wherein each of the red, green, and blue sub-pixels comprises:

an organic light emitting diode, a drive transistor comprising a source and a drain, one of which is electrically connected to the organic light emitting diode and an other of which is electrically connected to a second node to apply a drive current to the organic light emitting diode according to the voltage of a first node, the drive transistor further comprising a gate electrode electrically connected to the first node, a first switching transistor comprising a source and a drain, one of which is electrically connected to a corresponding data line and an other of which is directly electrically connected to the gate electrode of the drive transistor at the first node, and a gate electrode electrically connected to the scan line, the first switching transistor being turned on/off in response to the scan signal from the scan line, a second switching transistor comprising a source and a drain, one of which is electrically connected to the second node and an other of which is electrically connected to the power supply line to apply at least a portion of the drive current to the organic light emitting diode via the drive transistor, and a gate electrode coupled to the control line, the second switching transistor being turned on/off in response to the control signal from the control line, a first capacitor directly electrically connected to the first node and directly electrically connected to the power supply line, and a second capacitor electrically connected between the first node and the second node, wherein the red, green, and blue sub-pixels have different capacitance ratios of the first capacitors to the second capacitors, and wherein the second node is directly connected to a source of the drive transistor, the second capacitor, and a drain of the second switching transistor.

8. The OLED display device according to claim 7, wherein the second capacitors of the respective sub-pixels have capacitances inversely proportional to efficiencies of the organic light emitting diodes.

9. The OLED display device according to claim 8, wherein the first capacitors of the red, green, and blue sub-pixels have a same capacitance.

10. The OLED display device according to claim 7, wherein the first capacitors of the respective sub-pixels have capacitances proportional to efficiencies of the organic light emitting diodes.

11. The OLED display device according to claim 10, wherein the second capacitors of the red, green, and blue sub-pixels have a same capacitance.

12. The OLED display device according to claim 7, wherein at least two of the first switching transistor, the second switching transistor, and the drive transistor are a same type.

13. The OLED display device according to claim 12, wherein the first switching transistor, the second switching transistor, and the drive transistor are independently NMOS or PMOS transistors.

14. An organic light emitting diode (OLED) display device, comprising:

scan lines to apply scan signals;

control lines to apply control signals;

data lines to apply data signals;

power supply lines to provide voltages; and pixels to display different colors, each pixel comprising:

an organic light emitting diode, a drive transistor comprising a source and a drain, one of which is electrically connected to the organic light emitting diode and an other of which is electrically connected to a second node to apply a drive current to the organic light emitting diode according to the voltage of a first node, the drive transistor further comprising a gate electrode electrically connected to the first node, a first switching transistor comprising a source and a drain, one of which is electrically connected to a corresponding data line and an other of which is directly electrically connected to the gate electrode of the drive transistor at the first node, and a gate electrode electrically connected to the scan line, the first switching transistor being turned on/off in response to a corresponding scan signal from a corresponding scan line, a second switching transistor comprising a source and a drain, one of which is electrically connected to the second node and an other of which is electrically connected to a corresponding power supply line to apply at least a portion of the drive current to the organic light emitting diode via the drive transistor, and a gate electrode coupled to the control line, the second switching transistor turned on/off in response to a corresponding control signal from a corresponding control line, a first capacitor directly electrically connected to the first node and directly electrically connected to the corresponding power supply line, and a second capacitor electrically connected between the first node and the second node, wherein ratios of the first capacitors to the second capacitors of the pixels displaying different colors among the pixels are different, and wherein the second node is directly connected to a source of the drive transistor, the second capacitor, and a drain of the second switching transistor.

15. The OLED display device according to claim 14, wherein the ratios of the first capacitors to the second capacitors are inversely proportional to efficiencies of the organic light emitting diodes of the pixels.

16. The OLED display device according to claim 15, wherein the second capacitors have capacitances inversely proportional to the efficiencies of the organic light emitting diodes.

17. The OLED display device according to claim 16, wherein the first capacitors of respective pixels have a same capacitance.

18. The OLED display device according to claim 15, wherein the first capacitors have capacitances proportional to the efficiencies of the organic light emitting diodes.

19. The OLED display device according to claim 18, wherein the second capacitors of respective pixels have a same capacitance.

20. The OLED display device according to claim 14, further comprising: a demultiplexer for sequentially applying the data signals to the pixels.

* * * * *